US008781928B2

(12) United States Patent
Deng et al.

(10) Patent No.: US 8,781,928 B2
(45) Date of Patent: Jul. 15, 2014

(54) METHODOLOGY FOR CHARGING OF DISCRETE RESOURCE RESERVATION BASED SERVICES

(75) Inventors: Yu Deng, Yorktown Heights, NY (US); Thao N. Nguyen, Katonah, NY (US); Chang-Shing Perng, Bedford Hills, NY (US); Randy A. Rendahl, Raleigh, NC (US); Anca Sailer, Scarsdale, NY (US); Grzegorz M. Swirszcz, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 180 days.

(21) Appl. No.: 13/180,048

(22) Filed: Jul. 11, 2011

(65) Prior Publication Data

US 2013/0018764 A1 Jan. 17, 2013

(51) Int. Cl.
*G07F 19/00* (2006.01)

(52) U.S. Cl.
USPC ..... 705/34; 705/30

(58) Field of Classification Search
None
See application file for complete search history.

(56) References Cited

U.S. PATENT DOCUMENTS

| | | | | |
|---|---|---|---|---|
| 6,829,236 | B1 * | 12/2004 | Archer | 370/353 |
| 7,801,976 | B2 * | 9/2010 | Hodges et al. | 709/223 |
| 7,921,024 | B2 * | 4/2011 | Hogan et al. | 705/7.22 |
| 8,255,490 | B1 * | 8/2012 | Porter et al. | 709/219 |
| 8,290,471 | B1 * | 10/2012 | Jones et al. | 455/406 |
| 2003/0236745 | A1 * | 12/2003 | Hartsell et al. | 705/40 |
| 2004/0093381 | A1 * | 5/2004 | Hodges et al. | 709/204 |
| 2006/0161463 | A1 * | 7/2006 | Poonnen et al. | 705/4 |
| 2007/0011092 | A1 * | 1/2007 | Bishop et al. | 705/40 |
| 2007/0043655 | A1 | 2/2007 | Phillips et al. | 705/38 |
| 2008/0319910 | A1 * | 12/2008 | Duffus et al. | 705/52 |
| 2009/0193057 | A1 * | 7/2009 | Maes | 707/200 |
| 2012/0266185 | A1 * | 10/2012 | Davis et al. | 719/317 |

OTHER PUBLICATIONS

"The Market for 'Lemons': Quality Uncertainty and the Market Mechanism", George A. Akerlof, Quarterly Journal of Economics, vol. 84, No. 3, Aug. 1970, pp. 488-500.
"Hamiltonian Approach to Multi-dimensional Screening", Journal of Mathematical Economics 36, Jan. 2001, pp. 77-94.
"Competitive Price and Quality Under Asymmetric Information", Gerard J. Tellis and Birger Wernerfelt, Marking Science, vol. 6, No. 3, Summer 1987, pp. 240-253.
"Adverse Selection in Electronic Markets: Evidence From Online Stamp Auctions", Sanjeev Dewan and Vernon Hsu, The Journal of Industrial Economics, vol. LII, Dec. 2004, pp. 497-516.

(Continued)

*Primary Examiner* — Mussa A Shaawat
(74) *Attorney, Agent, or Firm* — Harrington & Smith; Louis J. Percello

(57) ABSTRACT

Methods, apparatus, and articles of manufacture are disclosed. These perform the following: accessing records of previous usage within a billing period of service units for customers, wherein the service units are discrete sizes of services for resource types, wherein each usage of an individual one of the service units has start and stop events, and wherein each resource type has a price fixed as of a date of the previous usage; dividing the billing period into time periods determined using the start and stop events for the usage of all of the service units; using the accessed records and the time periods and based on one or more criteria, assigning resource types to the previous usage in the time periods of the service units by the customers; and determining total charge for a selected customer based on the assignments of the resource types and corresponding prices for the selected customer.

18 Claims, 7 Drawing Sheets

(56) References Cited

OTHER PUBLICATIONS

"Adverse Selection in Online 'Trust' Certifications", Benjamin Edelman, Oct. 15, 2006, 38 pgs.

"A Supplier's Optimal Quantity Discount Policy Under Asymmetric Information", Charles J. Corbett and Xavier de Groote, Management Science, vol. 46, No. 3, Mar. 2000, pp. 444-450.

"Multidimensional Screening: Online Computation and Limited Information", Kimmo Berg and Harri Ehtamo, IECE 2008, 10 pgs.

* cited by examiner

METHODOLOGY FOR CHARGING OF DISCRETE RESOURCE RESERVATION BASED SERVICES

BACKGROUND

This invention relates generally to services, and, more specifically, relates to methods, apparatus and computer program products for charging for services.

Usage-based services are services that are charged by the duration of use for service units. Service units can have many different sizes. For instance, rental cars, cloud servers, telecom/conference call connections, and video streams are all examples of services units.

A customer typically reserves the service units via a packaged reservation: the customer can reserve a number of units in advance, usually for a discounted price. If the number of units in use exceeds the reservation, the extra units are charged at a higher price. The latter is called "pay as you go". There can be different packages of different sizes, with different prices.

SUMMARY

In exemplary embodiments, methods, apparatus, and articles of manufacture are disclosed. These exemplary embodiments perform the following: accessing records of previous usage within a billing period of service units for customers, wherein the service units are discrete sizes of services for resource types, wherein each usage of an individual one of the service units has start and stop events, and wherein each resource type has a price fixed as of a date of the previous usage; dividing the billing period into time periods determined using the start and stop events for the usage of all of the service units; using the accessed records and the time periods and based on one or more criteria, assigning resource types to the previous usage in the time periods of the service units by the customers; and determining total charge for a selected customer based on the assignments of the resource types and corresponding prices for the selected customer.

DETAILED DESCRIPTION

Services providing differentiated packages for reserving resources with tiered pricing that incur the same cost for the provider, face the problem of how to provision resources for and the price provided to the customer when the resources subscribed to breach the limits of the reservation or of pricing tiers (e.g., as defined by packages). To minimize the expense, the customers will be tempted to unsubscribe and resubscribe to resources to be sure they stay within the reserved or tier limits. These actions (as described below) will drive unnecessary oscillations of costly de-provisioning and re-provisioning in the data centers.

Examples of such services include, but are not limited to, the following: office space reservations, where different room sizes have different prices while the provider packages are for fixed total surface; call conference reservation system, where a conference calling number can have different number of lines that can be combined at different prices while the provider packages are for fixed total number of lines; cloud computing, where different size VMs (virtual machines) have different prices while the provider packages are for fixed total number of CPUs (central processing units, e.g., processors).

A problem with the usage-based services scenario previously described is that the service units are discrete, and the duration to be used is asynchronous. It is not always obvious how the usage should be charged. Furthermore, if the customers believe they can lower their price by performing some actions, those non-productive actions might increase providers operation cost. Additionally, customers may question the correctness of the billing.

It is noted that some description of terminology is helpful at this point. The term "cost" is usually associated with a service provider, while the term "price" or "charge" are associated with a customer. That is, the customer pays a certain price for a service unit. The service provider provides that service unit at the charge. The service provider has a cost for the service unit, and the charge minus the cost is the profit for the service provider. These terms are used throughout the instant disclosure in accordance with these definitions.

Figure 1:
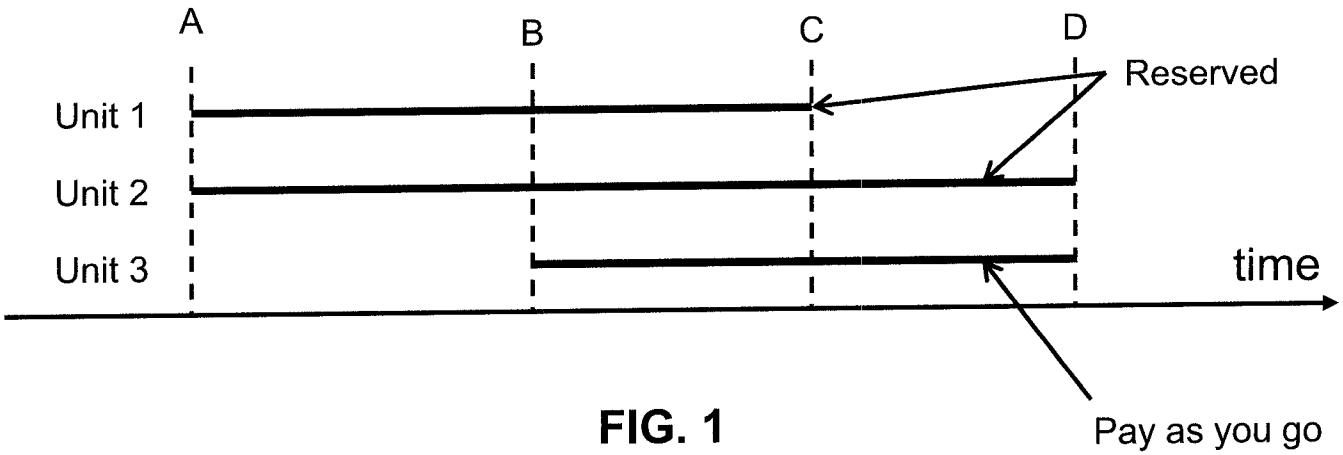
FIG. 1 is an example of reservations by a customer of three service units over time.
Figure 2:
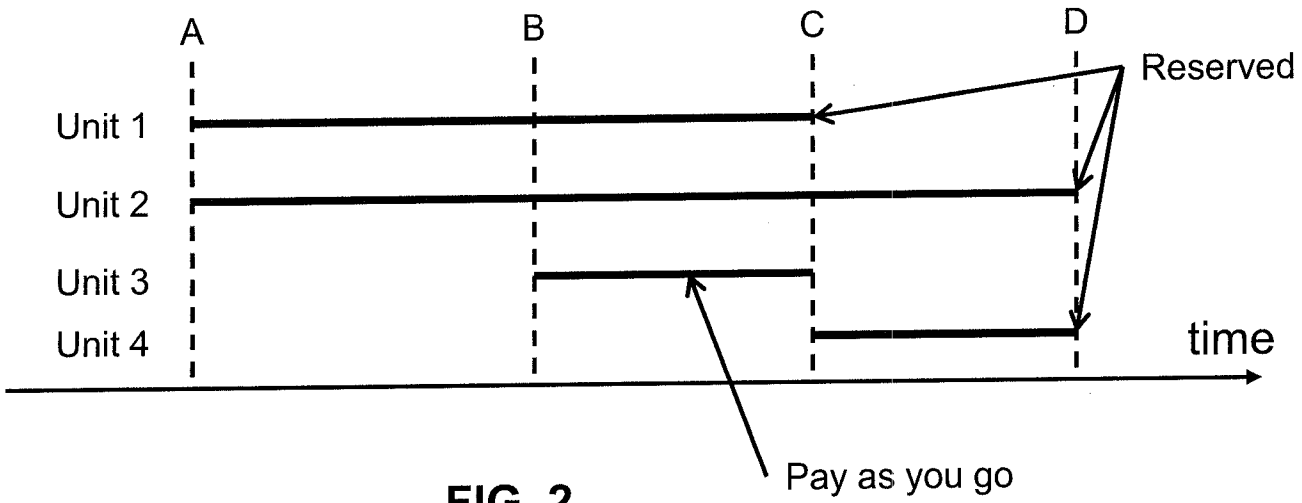
FIG. 2 is an example of reservations by a customer of four service units over time.

FIGS. 1 and 2 help to illustrate these problems. In FIG. 1, a customer has reserved Units 1 and 2 for the time period A-D. The actual usage of the customer includes not only Unit 1 (time period A-C) and Unit 2 (time period A-D) but also Unit 3 (time period B-D). Unit 3 is pay as you go because this unit is not reserved. A naïve scheme for charging this usage is the following: Units 1 and 2 are charged at a discount rate; and Unit 3 is charged at a regular (higher) rate (the "pay as you go" rate) because the number of units in use exceeds the maximum reserved for this customer when Unit 3 is placed into use (at line B).

In FIG. 2, the customer coordinates the usage to lower price. The customer could, for instance, split Unit 3 into two units (Units 3 and 4) (e.g., return a car and check out the same or another car again, de-provision a virtual machine then provision again, and the like). This is because the customer has reserved two units for the time period A-D and can therefore request any two units during that time period. Naïve charging for the scenario in FIG. 2 is the following: Units 1 and 2 are charged at discount rate; Unit 3 is charged at regular (higher) rate (the "pay as you go" rate) because the number of units in use exceeds the maximum reserved for this customer when Unit 3 is placed into use (at line B); and Unit 4 is charged at discount rate.

Such operation is not productive and increases cost of the provider, because the provider has to accept a returned car and rent another car, or de-provision a virtual machine then provision again.

Consider another example. Assume a customer reserved the following two cloud packages:

Package 1: 10 CPUs, 40 GB RAM, 5 TB Disk; and

Package 2: 50 CPUs, 250 GB RAM, 80 TB Disk.

That is, for instance, for Package 1, 10 central processing units (CPUs), 40 gigabyte (GB) of random access memory (RAM) and a five terabyte (TB) hard disk are reserved. The unit price (e.g., per CPU) is the following: Package 2<Package 1. A naïve charging scheme for this is as follows:

Set priority as follows: Package 2>Package 1>pay as you go; and

Deploy VM (virtual machine) based on the priority.

A less naïve scheme is to, whenever possible, move a VM from a lower priority package to a higher priority package. This is still not optimal or obvious. It is hard to determine, for instance, which VM should be moved.

In contrast to the above, an exemplary embodiment of the instant invention performs the following operations:

1) Divide the billing period to many smaller periods, using all "start" and "stop" events as dividers;

2) Formulate the problem as a linear integer programming problem and solve the problem for optimal placement; and 3) Sum up optimal charges of the periods.

Exemplary advantages of the instant invention include but are not limited to the following: The methodology guarantees the lowest possible charge to the customer (i.e., price for a customer), and prevents customers from performing non-productive operations to avoid paying higher prices in a pool of different prices.

Figure 3:
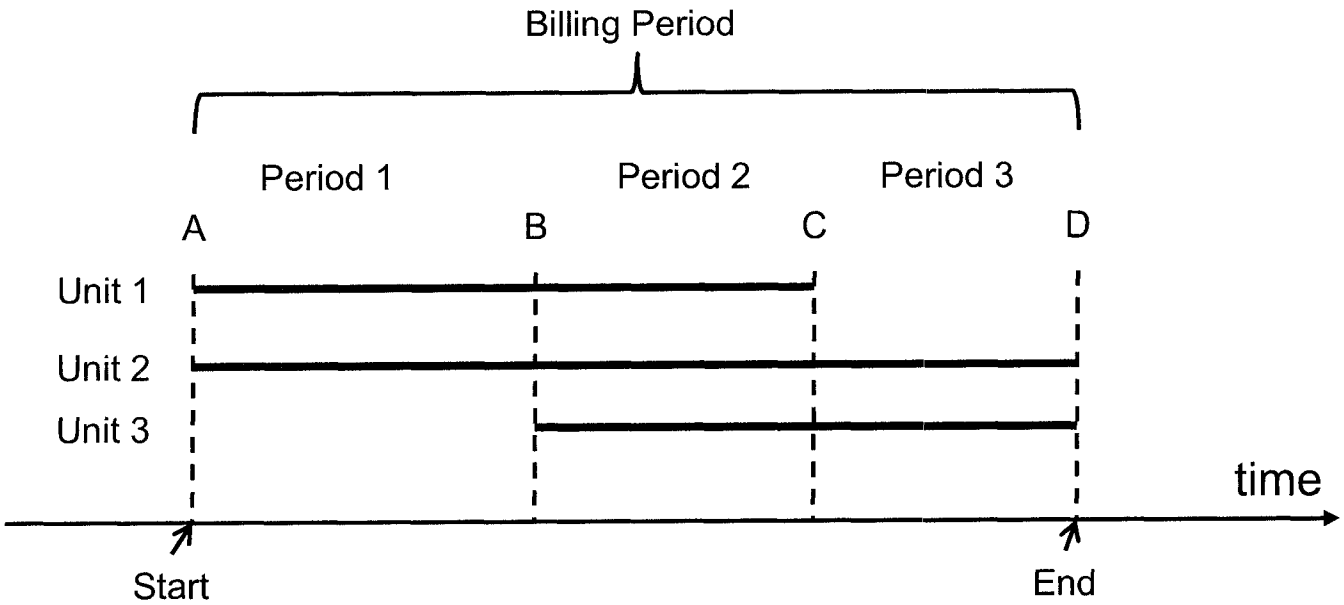
FIG. 3 is an example of dividing a charging period into a number of smaller periods, using "start" and "end" events for service unit use.

An introductory example will now be provided and will be followed by a more detailed example. For operation (1) above, the billing period is divided into a number of smaller time periods, using all "start" and "end" events as dividers to define the time periods. This is shown in FIG. 3. Period 1 is set between times A and B and corresponds to the start of use of Unit 1 and the start of use of Unit 2. Period 2 is set between times B and C and corresponds to the start of use of Unit 3 and the end of use of Unit 1. Period 3 is set between times C and D and corresponds to the end of use of Unit 1 and the end of use of Unit 2 (or the end of use of Unit 3). It is noted that multiple events occurring at the same time are used as a single divider. In other words, a start to Period 1 is defined by both the start of use of Unit 1 and the start of use of Unit 2.

The following assumptions are made. When a service unit is employed, there is no indication of the package to which the service unit belongs. The package is a concept of billing and does not affect deployment in any way. Package reservation prices are constants, and there is no effect by the prices on how the deployment is performed.

An exemplary formulation is as follows.

Goal: Minimize (Total Charge), based on the following constraints:

1. The number of service units used by a customer is equal to the number of service units assigned to packages; and 2. For each resource type, for each package, the number of service units assigned to the package is less than the total number of service units in the package.

This optimization problem is solved with a linear integer programming solver. The objective of total charge (for customers) is minimized in this example based on the constraints shown above. An example for Total Charge might be the following (for a single customer):

Total Charge for the billing period=(Hours of time spent in "reserved" space*reserved price)+ (Hours of time spent in "pay as you go" space*"pay as you go" price).

Typically, the Total Charge written in standard form would be of the type $c^t x$, where c is a vector of known coefficients, t indicates transpose, and x is a vector of variables to be determined. The vector of variables include the charges for each of (i.e., all of) the customers. It is noted that charge is from the perspective of the service provider but is considered herein to be equivalent to the price paid by the customer. That is, minimizing total charge is the same as minimizing total price.

Figure 4:
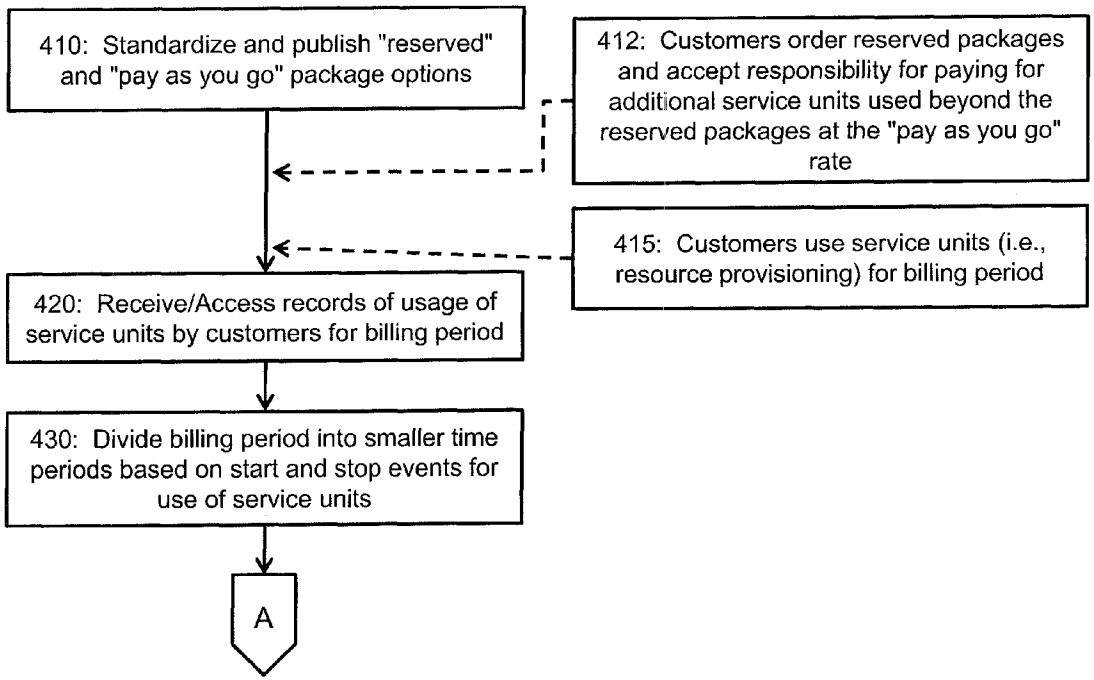
FIG. 4 is a flowchart of an exemplary method for charging of discrete resource reservation-based services.
Figure 4:
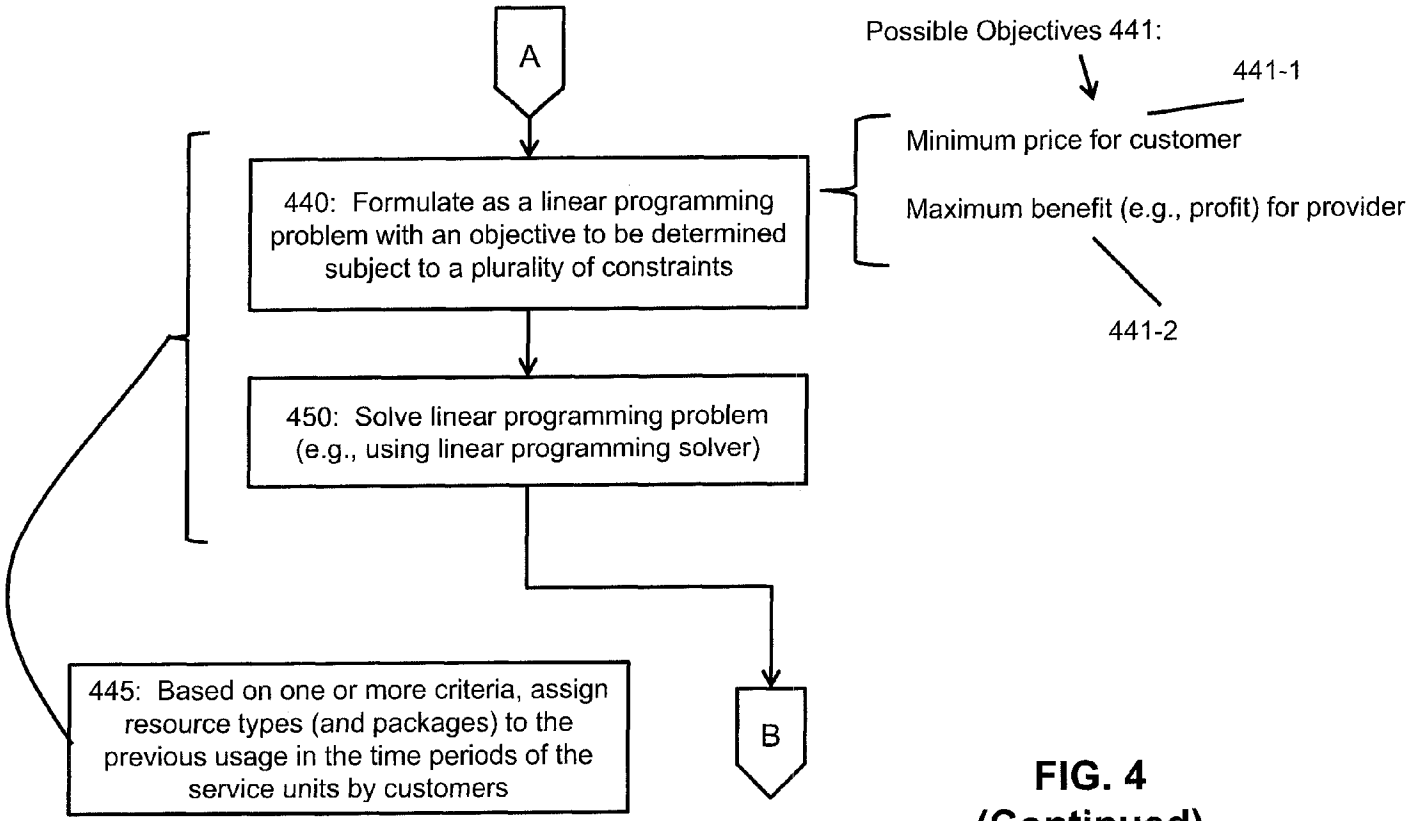
Figure 4:
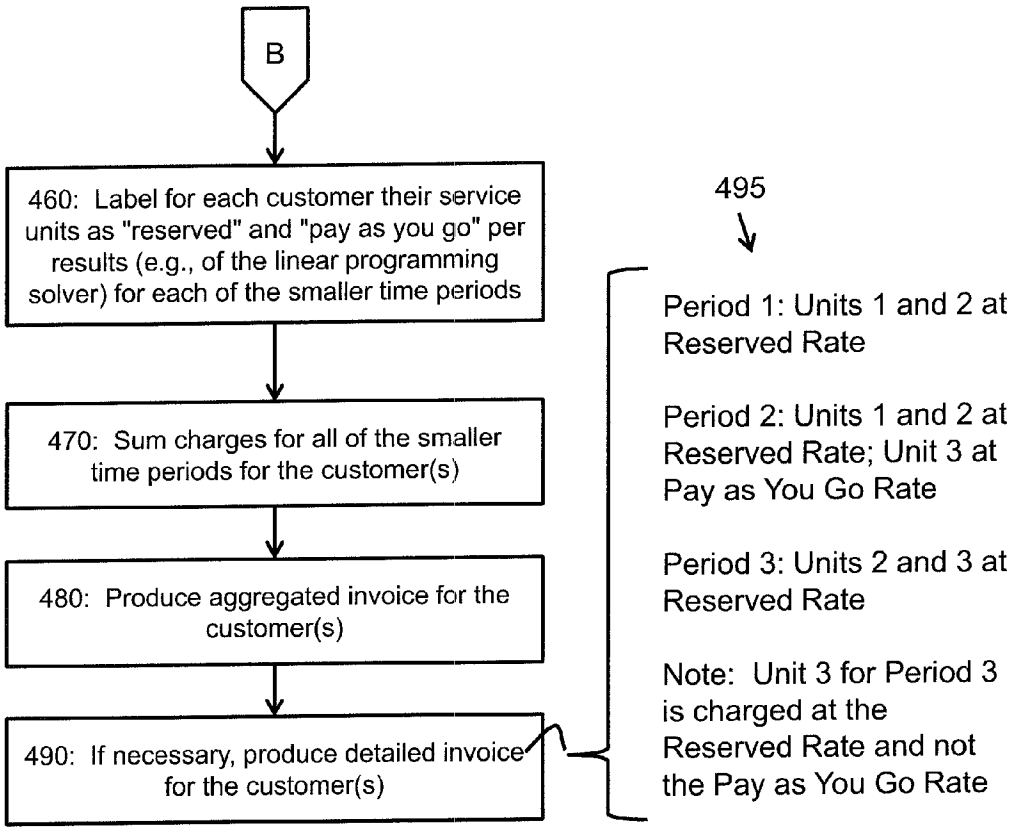
Figure 5:
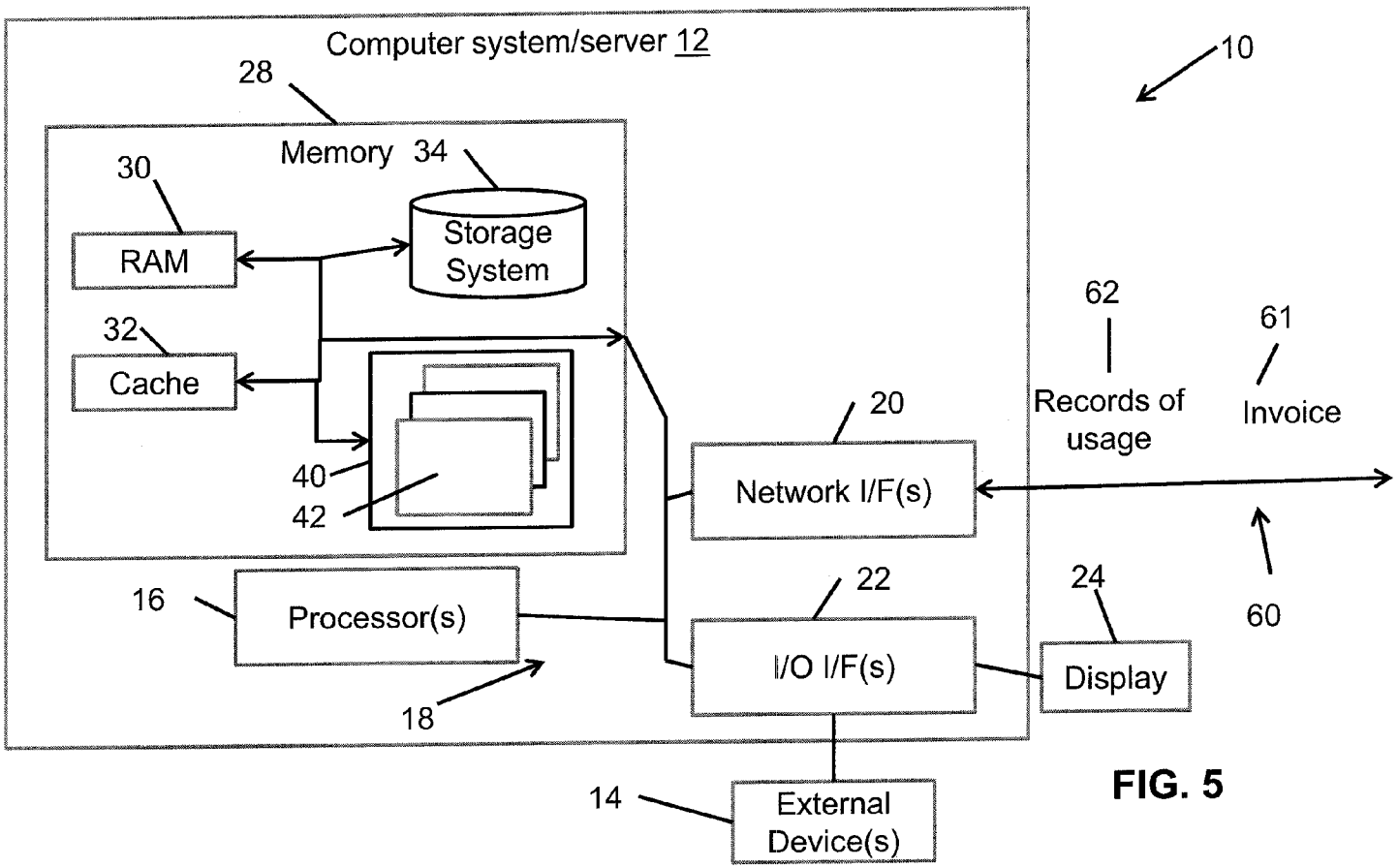
FIG. 5 is a block diagram of an exemplary system for performing exemplary embodiments of the instant invention.

FIG. 4 is a flowchart of an exemplary method for charging of discrete resource reservation-based services. A system for performing the method is shown in FIG. 5. In block 410, "reserved" and "pay as you go" package options are standardized and published by the service provider. These resource types (of "reserved" and "pay as you go") are merely exemplary and other or additional resource types may be used. For instance, there may be multiple reserved resource types, similar to coach, business, and first class for plane flights. The package options include various packages for each resource type and prices for a customer for each of the packages. As an example, for ease of provisioning of, e.g., compute cloud services in a datacenter, each "reserved" and "pay as you go" package option in terms of amount of CPU, RAM, storage, and the like, and the prices for the package options are standardized and made public.

In block 412, customers order reserved packages and accept responsibility for paying for additional service units used outside the reserved packages at the "pay as you go" rate. In block 415, customers use service units for a billing period. That is, resources are provisioned for customers and subsequent blocks of the method take place after resource provisioning.

In block 420, records of usage of service units by customers for billing period are accessed or received. The records of usage include, e.g., indications of service units and indications of their start and stop events (including corresponding times). The records are for a number of customers.

In block 430, the billing period is divided into smaller time periods based on start and stop events for use of service units. An example of this is explained above in reference to FIG. 3.

In block 440, a linear programming problem is formulated with an objective to be determined subject to a plurality of constraints. The linear programming problem is typically formed at least in part by a computer system, but may be formed at least in part by a user. The example provided above minimizes the objective of total charge subject to two constraints. The optimization in block 440 can target the possible objectives 441 of, for example, but not limited to, minimum price (i.e., charge) for a customer (as described above) (objective 441-1), or maximum benefit (e.g., maximum profit) for the provider (objective 441-2).

In block 450, the linear programming problem is solved, e.g., using a linear programming solver. Exemplary linear programming solvers include ILOG CPLEX, made by International Business Machines, and Clp (Coin-or linear programming), which is an open-source linear programming solver written in C++. It is noted that the results of the solver cover all of the customers for each of the time periods. In a typical linear programming problem and its solution, there are some decision variables (values that can be modified, e.g., the price for packages for the resource types of, e.g., "reserved" and "pay as you go"; the time periods each customer has for "reserved" packages and indications of the packages), constraints (conditions those values must satisfy), and an objective function (the value to be made minimal in an example using the good choice of values of decision variables). If the decision variables are continuous, a linear solver may be used. In case some or all decision variables can be only integers (say, number of computers, as one cannot ship one-half a computer) a mixed-integer programming problem can be solved using an appropriate solver. The exemplary solvers described above may be used for these purposes. Output of the solver includes optimal values of the decision variables, such as time for packages for each of the resource types for each of the customers (e.g., for customer 1, charge rate R1 for "reserved" for first two hours and then rate R2 for "pay as you go" for the remaining one hour of the total of three hours used by customer 1). In the example of minimizing total charge, the total charge for each customer is minimized for each time period across all time periods. An additional example is provided below.

In block 460, for each customer, their service units are labeled as "reserved" and "pay as you go" per results (e.g., of the linear programming solver) for each of the smaller time periods. That is, the results of the solver is accessed to determine for the particular customer the service units that have been assigned to the various "reserved" and "pay as you go" packages for the customer based on the results.

In block 470, charges are summed for all of the smaller time periods for the customer(s). This creates a total charge for the customer(s). Note that the total charge may also be subdivided by resource type (for example but not limited to "reserved" and "pay as you go"). In block 480, an aggregated invoice, containing the total charge, is produced for the customer(s). The aggregated invoice may also state the outstanding charges for "reserved" and "pay as you go" resources for the billing period and further may include the claim that the service provider charges the minimum amount for the utilized resource by a smart combination of resources between "reserved" and "pay as you go".

In block 490, if necessary, a detailed invoice is produced for the customer(s). This may occur, e.g., in the case of an invoice dispute. In the non-limiting example shown in FIG. 4, the detailed invoice 495 is based on the example of FIG. 3 for the corresponding customer. The detailed invoice 459 indicates the following: For Period 1, Units 1 and 2 were charged at the Reserved Rate; for Period 2, Units 1 and 2 where charged at the Reserved Rate and Unit 3 was charged at the Pay as You Go Rate; and for Period 3, Units 2 and 3 were charged at the Reserved Rate. Additionally, there is a note indicating that Unit 3 for Period 3 is charged at the Reserved Rate and not the Pay as You Go Rate. The detailed invoice 495 may also include, e.g., total charge for the billing period and charges for each smaller time period.

It is noted that, in broad terms, blocks 440 and 450 may be generalized so that resource types (and corresponding packages) are assigned, based on one or more criteria, to the previous usage in the time periods of the service units by the customers (block 445). That is, the usage of service units by the customers has already happened. Block 445 therefore determines what resource types (and corresponding packages having pricing structures for the resource types) can be assigned to the time periods (determined in block 430) in order to meet certain criteria such as minimum price for the customers or a selected customer. Blocks 440 and 450 are examples of how this might be performed, and the criteria involved can therefore include the objective and the constraints. However, the assignment of the resource types (and corresponding packages having pricing structures for the resource types) should not be limited to the techniques in blocks 440 and 450. Also, packages will generally be used, since most providers will have multiple packages involving multiple price structures for the various resource types (e.g., reserved, "pay as you go") and service units. However, packages are not necessary and the techniques provided herein are applicable to service units and corresponding resource types, where the service units are not assigned to packages.

Consider the following additional example using the reservations shown in FIG. 1. In FIG. 1, the customer reserves two units, Unit 1 and Unit 2. The customer uses Unit 1 for Period 1 and Period 2. The customer uses Unit 2 for Period 1, Period 2 and Period 3. The customer uses Unit 3 for Period 2 and Period 3. The following may also be determine:

Length of Period 1 is P1;

Length of Period 2 is P2;

Length of Period 3 is P3;

Rate for "Reserved" is R1;

Rate for "Pay as you go" is R2; and $$R2>R1.$$

Without an optimization, the customer would be charged based on the following formulas:

$$R1*P1+R1*P2+\text{(for Unit 1)}$$

$$R1*P1+R1*P2+R1*P3+\text{(for Unit 2)}$$

$$R2*P2+R2*P3\text{(for Unit 3).}$$

The above techniques would provide a different result. In accordance with the above techniques, the following decision variables are introduced:

$$U1P1, U1P2, U1P3,$$

$$U2P1, U2P2, U2P3, \text{ and}$$

$$U3P1, U3P2, U3P3.$$

where UiPj corresponds to usage of the Unit i during the period j. If UiPj is equal to 0 (zero) rate R2 is charged, whereas if UiPj is 1 (one), rate R1 is charged.

The following optimization problem may be formed (see, e.g., block 440 above):

Minimize the following:

$$(R1*U1P1+R2(1-U1P1)P1+$$

$$(R1*U1P2+R2(1-U1P2)P2+$$

$$(R1*U2P1+R2(1-U2P1)P1+$$

$$(R1*U2P2+R2(1-U2P2)P2+$$

$$(R1*U2P3+R2(1-U2P3)P3+$$

$$(R1*U3P2+R2(1-U3P2)P2+$$

$$(R1*U3P3+R2(1-U3P3)P3.$$

This is the objective function. The objective function is minimized subject to the following constraints:

$$U1P1+U2P1+U3P1<=2,$$

$$U1P2+U2P2+U3P2<=2,$$

$$U1P3+U2P3+U3P3<=2,$$

AND $$UiPj \text{ is in } \{0,1\}.$$

The "UiPj is in {0,1}" yields a total of nine constraints and forces decision variables to be integers (0 or 1) (i.e., zero or one).

The solution in this case is the following:

$$U1P1=1,$$

$$U1P2=1,$$

$$U1P3=0,$$

$$U2P1=1,$$

$$U2P2=1,$$

$$U2P3=1,$$

$$U3P1=0,$$

$U3P2=0$, and $U3P3=1$.

The situation without the optimization corresponds to the following:

$U1P1=1$, $U1P2=1$, $U1P3=0$, $U2P1=1$, $U2P2=1$, $U2P3=1$, $U3P1=0$, $U3P2=0$, and $U3P3=0$.

Therefore, using the techniques presented above, U3P3=1, meaning that the customer would be charged the cheaper rate R1 during Period 3 for the usage of Unit 3. By contrast, without using the techniques presented above, U3P3=0 in the non-optimized solution, meaning that the customer would be charged the more expensive rate R1 during Period P3 for the usage of Unit 3. The above example was presented in the context of units only, but the example is easily extendible to packages of units and corresponding prices for the packages.

FIG. 5 is a block diagram of an exemplary system for performing exemplary embodiments of the instant invention. Referring now to this figure, a schematic of an example of a computing node is shown. Computing node 10 is only one example of a suitable computing node and is not intended to suggest any limitation as to the scope of use or functionality of embodiments of the instant invention described herein. Regardless, computing node 10 is capable of being implemented and/or performing any of the functionality set forth hereinabove.

In computing node 10, there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs (personal computers), minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in, e.g., distributed cloud computing environments where tasks are performed by remote processing devices that are linked through a communications network. In a distributed cloud computing environment, program modules may be located in both local and remote computer system storage media including memory storage devices.

As shown in FIG. 5, computer system/server 12 in cloud computing node 10 is shown in the form of a general-purpose computing device. The components of computer system/server 12 may include, but are not limited to, one or more processors 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and the media may include both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (typically called a "hard drive"). Storage system 34 may also include a magnetic disk drive for reading from and writing to a removable, non-volatile magnetic disk (e.g., a "floppy disk"), or an optical disk drive for reading from or writing to a removable, non-volatile optical disk such as a CD-ROM (compact disk-read only memory), DVD-ROM (digital versatile disc-read only memory) or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the instant invention.

Program 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, and the like; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via wired or wireless network adapter 20 and link(s) 60. As depicted, network adapter 20 communicates with the other components of computer system/server 12 via bus 18. In this example, the records of usage 62 may be received (e.g., from a service provider) and an invoice (or invoices) 61 provided to one or more customers via link(s) 60.

It should be understood that although not shown, other hardware and/or software components could be used in conjunction with computer system/server 12. Examples, include, but are not limited to: microcode, device drivers, redundant processing units, external disk drive arrays, RAD (redundant array of independent disks), tape drives, and data archival storage systems, and the like.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method for execution by an apparatus comprising a memory including computer readable code and a processor configured to execute the computer readable code to perform at least:

accessing records of previous usage within a billing period of service units for a plurality of customers, wherein the service units are discrete sizes of services for a plurality of resource types, wherein each usage of an individual one of the service units has a start event and a stop event, and wherein each resource type has a price fixed as of a date of the previous usage;

dividing the billing period into a plurality of time periods determined using the start events and the stop events for the usage of all of the service units;

using the accessed records and the time periods and based on one or more criteria, assigning resource types to the previous usage in the time periods of the service units by the customers; and determining total charge for a selected customer based on the assignments of the resource types and corresponding prices for the selected customer for all of the time periods;

wherein assigning resource types further comprises:

using the accessed records and the time periods, formulating a linear programming problem with an objective to be determined subject to a plurality of constraints, wherein the criteria include the objective and the constraints; and solving the linear programming problem to create results, the results comprising the assignments of resource types to the time periods for the previous usage in the time periods of the service units by the customers;

wherein the linear programming problem is solved to determine a minimum price for the customers, or wherein the linear programming problem is solved to determine a maximum benefit for a provider of the service units.

2. The method of claim 1, wherein dividing the billing period into a plurality of time periods determined using start events and stop events for the usage of service units further comprises using all of the start events and all of the end events of the usage of the service units as dividers to define individual ones of the time periods, wherein multiple start events or end events occurring at a same time are used as a single divider.

3. The method of claim 1, further comprising creating an invoice for selected customer for the billing period based on the total charge and communicating the invoice to the selected customer.

4. The method of claim 1, wherein:

accessing records further comprises accessing information indicating a plurality of packages of the service units for the plurality of resource types, the plurality of packages having a plurality of corresponding prices for the customers, the prices for the packages based on the prices for the resource types; and assigning resource types further comprises:

using the accessed records including the information and the time periods, formulating the linear programming problem with the objective to be determined subject to the plurality of constraints; and solving the linear programming problem to create results, the results comprising assignments of packages to the time periods for the previous usage in the time periods of the service units by the selected customer.

5. The method of claim 1, wherein solving further comprises solving the linear programming problem with a linear programming solver.

6. The method of claim 1, wherein the plurality of resource types comprise reserved and "pay as you go".

7. An apparatus comprising:

one or more memories comprising one or more programs;

one or more processors coupled to the one or more memories and configured in response to execution of the one or more programs to cause the apparatus to perform at least the following:

accessing records of previous usage within a billing period of service units for a plurality of customers, wherein the service units are discrete sizes of services for a plurality of resource types, wherein each usage of an individual one of the service units has a start event and a stop event, and wherein each resource type has a price fixed as of a date of the previous usage;

dividing the billing period into a plurality of time periods determined using the start events and the stop events for the usage of all of the service units;

using the accessed records and the time periods and based on one or more criteria, assigning resource types to the previous usage in the time periods of the service units by the customers; and determining total charge for a selected customer based on the assignments of the resource types and corresponding prices for the selected customer for all of the time periods;

wherein assigning resource types further comprises:

using the accessed records and the time periods, formulating a linear programming problem with an objective to be determined subject to a plurality of constraints, wherein the criteria include the objective and the constraints; and solving the linear programming problem to create results, the results comprising the assignments of resource types to the time periods for the previous usage in the time periods of the service units by the customers;

wherein the linear programming problem is solved to determine a minimum price for the customers, or wherein the linear programming problem is solved to determine a maximum benefit for a provider of the service units.

8. The apparatus of claim 7, wherein dividing the billing period into a plurality of time periods determined using start events and stop events for the usage of service units further comprises using all of the start events and all of the end events of the usage of the service units as dividers to define individual ones of the time periods, wherein multiple start events or end events occurring at a same time are used as a single divider.

9. The apparatus of claim 7, wherein the one or more processors are further configured in response to execution of the one or more programs to cause the apparatus to perform at least the following: creating an invoice for selected customer for the billing period based on the total charge and communicating the invoice to the selected customer.

10. The apparatus of claim 7, wherein:

accessing records further comprises accessing information indicating a plurality of packages of the service units for the plurality of resource types, the plurality of packages having a plurality of corresponding prices for the customers, the prices for the packages based on the prices for the resource types; and assigning resource types further comprises:

using the accessed records including the information and the time periods, formulating the linear programming problem with the objective to be determined subject to the plurality of constraints; and solving the linear programming problem to create results, the results comprising assignments of packages to the time periods for the previous usage in the time periods of the service units by the selected customer.

11. The apparatus of claim 7, wherein solving further comprises solving the linear programming problem with a linear programming solver.

12. The apparatus of claim 7, wherein the plurality of resource types comprise reserved and "pay as you go".

13. An article of manufacture comprising a non-transitory computer-readable medium bearing computer program code embodied therein for use with a computer, the computer program code comprising:

code for accessing records of previous usage within a billing period of service units for a plurality of customers, wherein the service units are discrete sizes of services for a plurality of resource types, wherein each usage of an individual one of the service units has a start event and a stop event, and wherein each resource type has a price fixed as of a date of the previous usage;

code for dividing the billing period into a plurality of time periods determined using the start events and the stop events for the usage of all of the service units;

code for, using the accessed records and the time periods and based on one or more criteria, assigning resource types to the previous usage in the time periods of the service units by the customers; and code for determining total charge for a selected customer based on the assignments of the resource types and corresponding prices for the selected customer for all of the time periods;

wherein assigning resource types further comprises:

using the accessed records and the time periods, formulating a linear programming problem with an objective to be determined subject to a plurality of constraints, wherein the criteria include the objective and the constraints; and solving the linear programming problem to create results, the results comprising the assignments of resource types to the time periods for the previous usage in the time periods of the service units by the customers;

wherein the linear programming problem is solved to determine a minimum price for the customers, or wherein the linear programming problem is solved to determine a maximum benefit for a provider of the service units.

14. The article of manufacture of claim 13, wherein dividing the billing period into a plurality of time periods determined using start events and stop events for the usage of service units further comprises using all of the start events and all of the end events of the usage of the service units as dividers to define individual ones of the time periods, wherein multiple start events or end events occurring at a same time are used as a single divider.

15. The article of manufacture of claim 13, wherein the computer program code further comprises: creating an invoice for selected customer for the billing period based on the total charge and communicating the invoice to the selected customer.

16. The article of manufacture of claim 13, wherein:

accessing records further comprises accessing information indicating a plurality of packages of the service units for the plurality of resource types, the plurality of packages having a plurality of corresponding prices for the customers, the prices for the packages based on the prices for the resource types; and assigning resource types further comprises:

using the accessed records including the information and the time periods, formulating the linear programming problem with the objective to be determined subject to the plurality of constraints; and solving the linear programming problem to create results, the results comprising assignments of packages to the time periods for the previous usage in the time periods of the service units by the selected customer.

17. The article of manufacture of claim 13, wherein solving further comprises solving the linear programming problem with a linear programming solver.

18. The article of manufacture of claim 13, wherein the plurality of resource types comprise reserved and "pay as you go".

* * * * *